US007089862B1

(12) United States Patent
Vasquez

(10) Patent No.: US 7,089,862 B1
(45) Date of Patent: Aug. 15, 2006

(54) WATER POD

(76) Inventor: Robert Vasquez, 1904 Wickshire Ave., Hacienda Heights, CA (US) 91745

( * ) Notice: Subject to any disclaimer, the term of this patent is extended or adjusted under 35 U.S.C. 154(b) by 0 days.

(21) Appl. No.: 10/754,233

(22) Filed: Jan. 9, 2004

Related U.S. Application Data

(60) Provisional application No. 60/439,022, filed on Jan. 9, 2003.

(51) Int. Cl.
*F42B 12/46* (2006.01)
*A62C 13/00* (2006.01)

(52) U.S. Cl. ..... 102/369; 102/293; 102/382; 102/396; 169/28; 169/36; 111/200

(58) Field of Classification Search ..... 102/367, 102/368, 369, 370, 382, 396, 293; 169/28, 169/36, 58; 111/200, 900, 919; 47/1.01 R
See application file for complete search history.

(56) References Cited

U.S. PATENT DOCUMENTS

| | | | | | |
|---|---|---|---|---|---|
| 117,891 | A * | 8/1871 | Johnson | 169/36 |
| 2,306,321 | A * | 12/1942 | Roberts | 244/136 |
| 2,359,573 | A * | 10/1944 | Mackay | 169/36 |
| 2,377,675 | A * | 6/1945 | Choate et al. | 102/482 |
| 2,476,973 | A * | 7/1949 | Gillon | 102/364 |
| 3,176,836 | A * | 4/1965 | Gunn | 206/575 |
| 3,833,064 | A * | 9/1974 | Ranney, Jr. | 169/52 |
| 4,285,403 | A * | 8/1981 | Poland | 169/28 |
| 4,964,469 | A * | 10/1990 | Smith | 169/28 |
| 5,590,717 | A * | 1/1997 | McBay et al. | 169/52 |
| 6,012,531 | A * | 1/2000 | Ryan | 169/36 |
| 6,318,473 | B1 * | 11/2001 | Bartley et al. | 169/26 |
| 6,364,026 | B1 * | 4/2002 | Doshay | 169/47 |
| 6,470,805 | B1 * | 10/2002 | Woodall et al. | 102/370 |
| 6,474,564 | B1 * | 11/2002 | Doshay et al. | 239/46 |
| 6,725,941 | B1 * | 4/2004 | Edwards et al. | 169/47 |
| 6,796,382 | B1 * | 9/2004 | Kaimart | 169/43 |
| 2001/0025712 | A1 * | 10/2001 | Pagan | 169/70 |

* cited by examiner

*Primary Examiner*—Michael J. Carone
*Assistant Examiner*—James S. Bergin
(74) *Attorney, Agent, or Firm*—Kenneth L Tolar

(57) ABSTRACT

A water pod for assisting a user in extinguishing forest fires includes a hollow shell constructed with a biodegradable plastic that ruptures upon impact when dropped from an aircraft. The shell includes a fill port allowing it to be filled with water or another flame retardant material. The shell may include a detonation device allowing the pod to be ruptured prior to impact, if desired.

10 Claims, 1 Drawing Sheet

WATER POD

CROSS REFERENCE TO RELATED APPLICATIONS

This application is entitled to the benefit of provisional application No. 60/439,022 filed on Jan. 9, 2003.

BACKGROUND OF THE INVENTION

The present invention relates to a water pod for assisting firefighters in extinguishing forest fires.

DESCRIPTION OF THE PRIOR ART

Uncontrollable forest fires cause significant death and destruction each year. Currently, such fires are extinguished by dropping fluid or another fire retardant material from an overhead helicopter or airplane. However, the airborne fluid tends to disperse prior to reaching a target site resulting in a significant portion never contacting the fire. Accordingly, in order to minimize wastage, a pilot must fly the aircraft at low altitudes and only during daylight hours in order to safely and accurately follow the underlying fire.

Furthermore, flame retardant is typically dropped from specially designed air tankers that can only be practically used for a single purpose, i.e. storing and dispensing flame retardant. Accordingly, the costly aircrafts are idle for a significant portion of each year thereby significantly reducing their cost effectiveness. Additionally, air tankers are usually equipped with large capacity storage tanks—i.e. 3,000 gallons or more, which are expensive to construct and maintain.

The present invention overcomes the above described problems associated with conventional aerial firefighting techniques by providing a rupturable pod capable of holding a significant volume of water or other flame retardant. The pod can be easily loaded onto and released from virtually any conventional aircraft. When the pod impacts the ground, it immediately ruptures, releasing the entirety of the flame retardant at the point of impact.

SUMMARY OF THE INVENTION

The present invention relates to a water pod for assisting a user in extinguishing fires. The device comprises a hollow shell having an interior chamber capable of storing a predetermined volume of water or other flame retardant. In the preferred embodiment, the predetermined volume is approximately 250 gallons though the size can be varied to suit a particular application. The pod is constructed with a biodegradable plastic having frangible seams that separate upon impact. On an upper end of the pod is a fill port enclosable with a removable cap allowing the pod to be filled with water or flame retardant material at a location near the fire. The pod may also include a barometric, timer or remote controlled detonation device that will fracture the pod prior to impact. Accordingly, water could be strategically delivered to burning treetops, if desired. Furthermore, a packet of vegetation seeds can be attached to the pod shell whereby an area decimated by fire is automatically reseeded as the pod bursts.

It is therefore an object of the present invention to provide a water pod that assists a user in extinguishing a forest fire.

It is another object of the present invention to provide a water pod that enables a user to precisely direct a large volume of water toward a forest fire.

It is yet another object of the present invention to provide a water pod that immediately ruptures upon impact.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
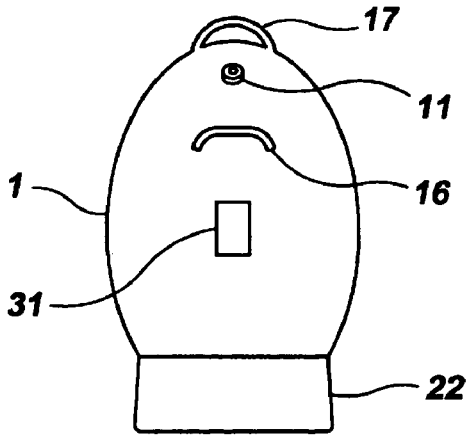
FIG. 1 is a front view of the water pod.

The present invention relates to a water pod for assisting a user in extinguishing fires. The device comprises a hollow shell 1 having an interior chamber capable of containing a predetermined volume of water or other flame retardant. In the preferred embodiment, the predetermined volume is approximately 250 gallons although the size can be varied to suit a particular application. The shell includes frangible seams 3 and a thin outer wall 4 so that the pod immediately bursts upon impact with the ground. The shell is constructed with a biodegradable plastic so as to naturally degrade into the environment after use. The shell includes a lower end having an integral base portion 22 for supporting the shell in an upright position for storing or filling. The base portion is much thicker than the shell outer wall so as to remain intact under the weight of a full pod.

Figure 2:
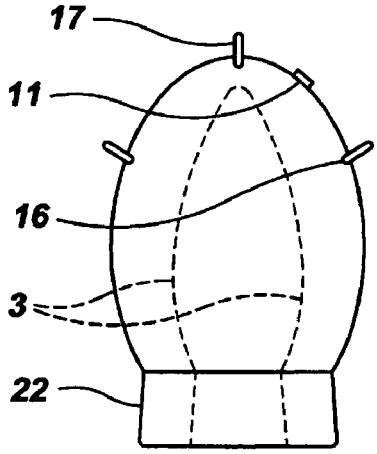
FIG. 2 is a side view of the water pod.
Figure 3:
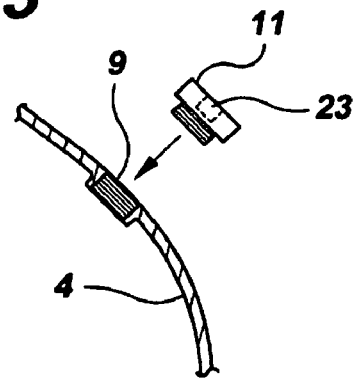
FIG. 3 is a close-up view of the fill port and cap.

Now referring specifically to FIGS. 1–3, on an upper end of the shell is a fill port 9 enclosable with a removable cap 11 allowing the pod to be filled with water or flame retardant material at a location near the fire. Preferably, the cap includes a drive socket 23 allowing the cap to be easily loosened or tightened with a wrench or similar tool. A pair of diametrically opposed handles 16 are positioned proximal the top end of the shell that allow a user to manually manipulate an empty shell or slightly manipulate a full one, if necessary or desired. In addition, a lifting hook 17 is mounted on the upper end allowing lifting machinery to load a full pod onto an aircraft.

Figure 4:
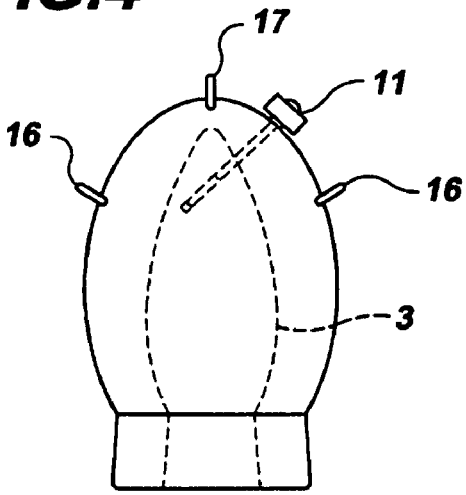
FIG. 4 is a side view of the water pod having a detonation device secured to the fill port cap.
Figure 5:
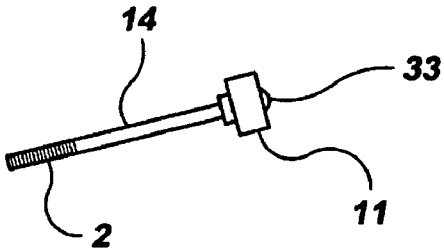
FIG. 5 is a detailed view of the detonation device.

Now referring specifically to FIGS. 4 and 5, the pod may also include any one of a plurality of detonation devices 14 allowing a user to selectively rupture the shell prior to impact. The detonation device includes a charge package that explodes when activated and which is incorporated into the refill port cap. The charge package is encapsulated within a plastic, sealed tube 2 to keep the package dry. Accordingly, by activating the charge package while the pod is airborne, water could be strategically delivered to burning treetops, if desired.

The detonation activation means can be barometric whereby it explodes at a predetermined altitude, or controlled with a timer that could be pre-set to detonate after a selected duration. The device could also include a remote controllable activation means for detonation by the flight crew. Each of the three variations includes an arming switch 33 disposed on the exterior of the refill cap. In addition, the device could include a "static line" attached at one end to the pod and at another end to the aircraft. When the pod is released from the aircraft and the line is completely extended, the recoil tension applied to the pod by the line will cause it to immediately burst.

Furthermore, a packet 31 of vegetation seeds may be adhesively secured to the shell, which can be poured into the interior chamber prior to use. Accordingly, an area decimated by fire is automatically re-seeded as the shell bursts.

The above described device is not to be limited to the exact details of construction and enumeration of parts depicted and described. Furthermore, the size, shape and materials of construction can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A water pod comprising:

a hollow shell formed of a rupturable material, said shell including an interior storage chamber; wherein said shell includes a lower end having an integral base portion thereon for supporting said shell in an upright position; wherein said shell further includes an upper end having a fill port thereon, said fill port having a cap removably attached thereto allowing a user to fill said interior chamber with flame retardant;

a flame retardant received within said storage chamber whereby said shell ruptures upon impact with an object to release the flame retardant at an impact location;

a packet adhesively attached to said shell, said packet having vegetation seeds received therein allowing a user to place said vegetation seeds into said interior chamber so that said seeds are dispersed to said impact location;

a detonation means for rupturing said shell prior to impact with an object;

an arming switch positioned on the cap for selectively arming said detonation means.

2. The water pod according to claim 1 wherein said detonation means includes a charge package incorporated into the cap.

3. The water pod according to claim 2 wherein said charge package is encapsulated within a plastic, sealed tube to keep the package dry.

4. The water pod according to claim 3 wherein the cap includes a drive socket allowing the cap to be easily loosened and tightened with a tool.

5. The water pod according to claim 4 said detonation means comprises a barometric activated explosive that is activated at a predetermined altitude.

6. The water pod according to claim 4 wherein said detonation means comprises a timer controlled explosive for exploding said shell upon expiration of a predetermined duration.

7. The water pod according to claim 4 wherein said detonation means comprises a "static line" attached at one end to the pod and at another end to an aircraft whereby when the pod is released from the aircraft and the line is completely extended, recoil tension applied to the pod by the line will cause it to immediately burst.

8. The water pod according to claim 4 wherein said shell includes at least one frangible seam for allowing said shell to easily burst upon impact with an object.

9. The water pod according to claim 8 further comprising a pair of handles on the upper end of said shell.

10. The water pod according to claim 9 further comprising a hook on the upper end of said shell for coupling with a lifting means for loading a filled pod onto an aircraft.

* * * * *